United States Patent [19]

Weber et al.

[11] 3,959,421

[45] May 25, 1976

[54] METHOD FOR RAPID QUENCHING OF MELT BLOWN FIBERS

[75] Inventors: Robert E. Weber; Richard M. Peterson, both of Appleton, Wis.

[73] Assignee: Kimberly-Clark Corporation, Neenah, Wis.

[22] Filed: Apr. 17, 1974

[21] Appl. No.: 461,740

[52] U.S. Cl. ..... 264/6; 264/11; 264/12; 264/13; 264/14

[51] Int. Cl.[2] ..... B01J 2/06

[58] Field of Search ..... 264/6, 12, 13, 14, 11

[56] References Cited

UNITED STATES PATENTS 3,676,242 7/1972 Prentice ..... 156/62.4

OTHER PUBLICATIONS

A. Wente, "Superfine Thermoplastic Fibers," Indus. & Engng. Chem., Vol. 48, No. 8, Aug. 1956.

*Primary Examiner*—Robert F. White
*Assistant Examiner*—J. R. Hall
*Attorney, Agent, or Firm*—Wolfe, Hubbard, Leydig, Voit & Osann, Ltd.

[57] ABSTRACT

A method for producing a nonwoven fabric-like material by a melt blowing technique. Conventional melt blowing equipment is used to form a gas stream containing melt blown microfibers comprising generally discontinuous thermoplastic polymeric microfibers having an average fiber diameter of up to about 10 microns. A liquid, such as water, is sprayed into the gas stream to rapidly cool the fibers and the gas, thereby allowing the production of high quality product at production rates significantly higher than in conventional melt blowing technology. In the final integrated fibrous mat formed on the forming surface, the microfibers are held together by gross mechanical entanglement with each other. The quenching liquid is preferably sprayed into the gas stream from opposite sides, and the temperature of the gas stream is preferably substantially higher than the boiling point of the quenching liquid in the area where the liquid is sprayed into the gas stream so that the liquid is quickly evaporated upon contact with the gas stream.

4 Claims, 6 Drawing Figures

SAMPLE A

SAMPLE B

SAMPLE G

SAMPLE H

METHOD FOR RAPID QUENCHING OF MELT BLOWN FIBERS

DESCRIPTION OF THE INVENTION

The present invention relates generally to the production of nonwoven fabric-like materials and, more particularly, to an improved melt blowing method for producing nonwoven fabric-like materials.

It is a primary object of the present invention to provide an improved method for producing a nonwoven fabric-like material of melt blown fibers at high production rates.

It is another object of this invention to provide such an improved method which achieves significant increases in production rates with only a nominal increase in capital and operating costs, and while maintaining a high quality product.

A further object of the invention is to provide such an improved method which produces a high quality, textile-like product with increased drape, softness, tear strength, stretch, and tensile strength, and reduced levels of non-fibrous polymer or "shot."

Other objects and advantages of the invention will be apparent from the following detailed description and the accompanying drawings, in which.

While the invention will be described in connecttion with certain preferred embodiments, it is to be understood that the invention is not to be limited to those embodiments. On the contrary, it is intended to cover all alternatives, modifications, and equivalents as can be included within the spirit and scope of the invention as defined in the appended claims.

Figure 1:
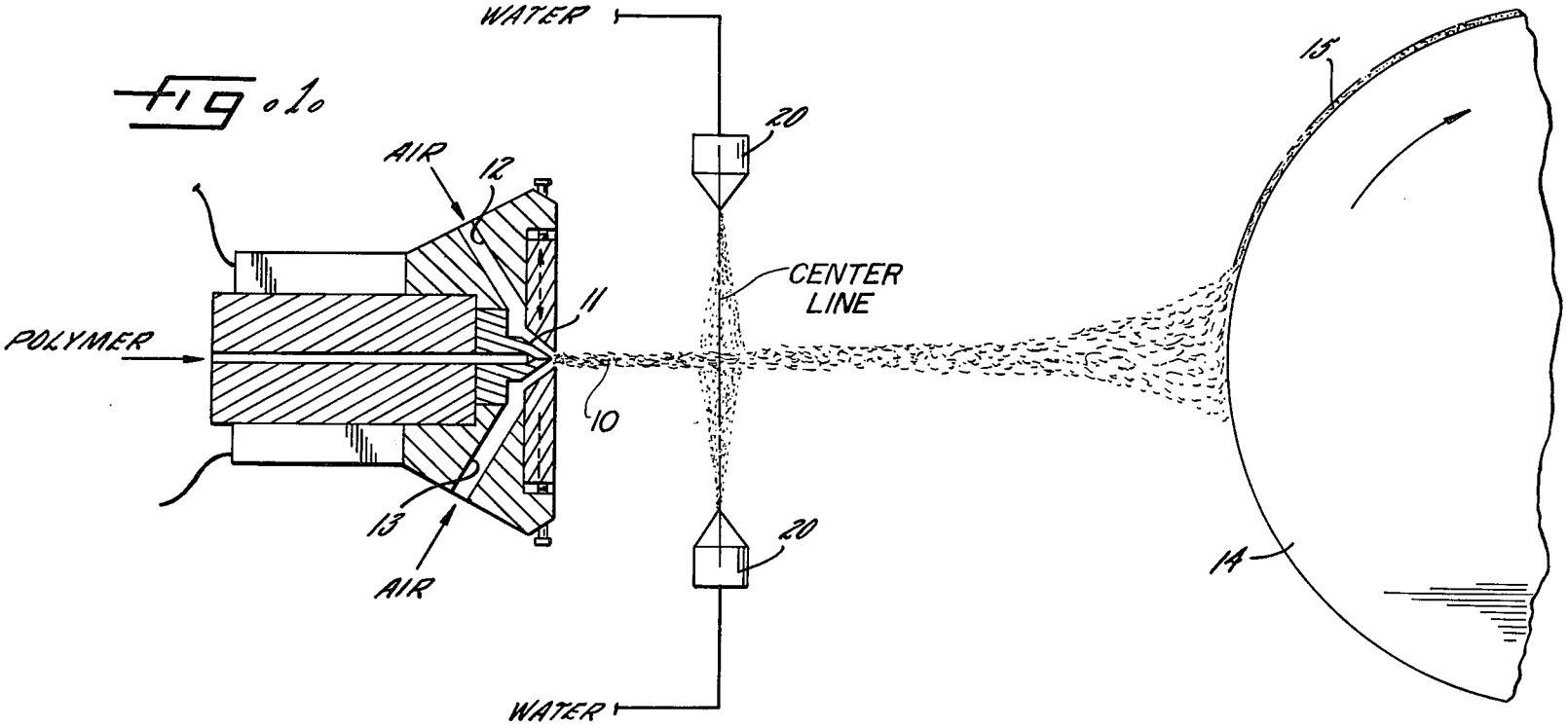
FIG. 1 is a schematic side elevation of a method and apparatus for producing nonwoven materials in accordance with the present invention.

Turning now to the drawings and referring first to FIG. 1, a gas stream 10 containing discontinuous polymeric microfibers is formed by a known melt blowing technique, such as the one described in an article entitled "Superfine Thermoplastic Fibers" appearing in Industrial and Engineering Chemistry, Vol. 48, No. 8, pp 1342–1346, which describes work done at the Naval Research Laboratories in Washington, D.C. Also, see Naval Research Laboratory Report No. 111437, dated Apr. 15, 1954 and U.S. Pat. No. 3,676,242 issued July 11, 1972 to Prentice. Basically, the method of formation involves extruding a molten polymeric material through a die head 11 into fine streams and attenuating the streams by converging flows of high velocity, heated gas (usually air) supplied from nozzles 12 and 13 to break the streams into discontinuous microfibers of small diameter. In general, the resulting microfibers have an average fiber diameter of less than about 10 microns with very few, if any, of the microfibers exceeding 10 microns in diameter. Usually, the average diameter of the microfibers is within the range of about 2– 6 microns, typically averaging about 5 microns. While the microfibers are predominately discontinuous, they generally have a length exceeding that normally associated with staple fibers.

There are a number of different thermoplastic polymers that can be used in forming the melt blown microfibers, so that materials can be fashioned with different physical properties by the appropriate selection of polymers or combinations thereof. Among the many useful thermoplastic polymers, polyolefins such as polypropylene and polyethylene, polyamides, polyesters such as polyethylene teraphthalate, and thermoplastic elastomers such as polyurethanes are anticipated to find the most widespread use in the preparation of the materials described herein.

Figure 2:
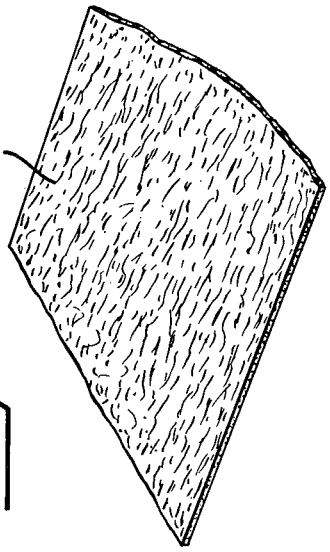
FIG. 2 is a perspective view of a fragment of a nonwoven material produced by the method and apparatus of FIG. 1.

In order to convert the melt blown microfibers in the stream 10 into an integral fibrous mat, the stream 10 is directed onto a hollow foraminous forming roll 14 or moving wire belt typically located about 4 to 12 inches from the die 11. The microfibers are deposited on the roll surface or moving wire belt and become grossly entangled with each other to form a continuous self-supporting fibrous web 15 as illustrated in FIG. 2. From the forming roll 14, the web 15 is withdrawn onto a windup roll. In conventional melt blowing technology, a second stream of ambient temperature air (secondary air) is directed into the primary gas jet to cool both the primary gas and the polymer. Very large volumes of secondary air (approximately 10 parts secondary air to one part primary gas) are required to cool the fiber-containing jet down to even moderate temperatures (150°F). Mixing of these large volumes of air occurs relatively slowly, resulting in a relatively slow rate of fiber cooling.

In accordance with this invention, the melt blown microfibers in the gas stream 10 are rapidly quenched before they reach the forming roll 14 by spraying a liquid into the gas stream near the die tip. It has been found that this liquid quenching step permits a high quality fibrous web to be formed at significantly faster production rates without leading to excessive formation of "shot" or non-fibrous polymer in the final web. Heretofore, attempts to operate at faster production rates, e.g., at polymer rates above 1.5 lbs./hr./in. of die length, have led to increased amounts of non-fibrous polymer and excessive fiber bonding in the web, which in turn degraded the hand, drape and tear characteristics and tensile strength of the product. By using the liquid quenching step of the invention, it has been possible to operate at polymer rates in excess of 3 lbs./hr./in. of die length without any degradation of the final product. And of course a production rate increase of this order of magnitude translates into significant increases in efficiency and corresponding reductions in the cost of both production equipment and the final product.

The effect of this liquid quenching step in preventing the formation of "shot" in the final product at high production rates is surprising in view of the fact that the formation of "shot" was previously believed to have been the result of an interruption in the flow of polymer through the extrusion die. Thus, it was believed that whenever the flow of a fiber was momentarily interrupted, a globule of polymer would precede the next fiber. However, even though the liquid quenching step of the present invention is carried out downstream of the extrusion die, it has been found to prevent the formation of excessive amounts of "shot" at higher production rates than were possible heretofore. Equally significant, the liquid quench avoids excessive fiber bonding in the final web, which leads to a product with more textile-like properties.

AS illustrated in FIG. 1, the liquid quench may be effected by means of a series of spray nozzles 20 disposed on opposite sides of the gas stream 10 as close as ½ inch to the die 11, and preferably not more than 6 inches from the die. These nozzles 20 are typically air atomization nozzles which break up the liquid in a very fine droplet pattern that expands outwardly from each nozzle so that the liquid is quickly evaporated upon contact with the gas stream 10. The temperature of the gas stream 10 in the area where it contacts the liquid spray from the nozzles 20 is preferably substantially above the boiling point of the liquid being sprayed, e.g. in the case of water the temperature of the gas stream should be at least 250°F. In actual practice, the temperature of the gas stream as it leaves the die nozzles is normally on the order of 600°F. so the gas stream temperature is actually well above 250°F in the area where the liquid spray is introduced. It is preferred to use a liquid spray rate as high as possible, to achieve maximum cooling, without producing a wet web, i.e., a web containing entrapped droplets of liquid which was not evaporated upon contact with the hot air stream.

The preferred quench liquid is water, although other liquids having a high latent heat of evaporation may also be used. In general, it is desired to achieve the maximum cooling effect from the liquid spray, and the cooling effect increases with increasing latent heat of evaporation.

In a series of examples illustrating the preparation of nonwoven materials in accordance with the present invention, eight webs of melt blown polymeric microfibers were prepared according to the general procedure described above and illustrated in FIG. 1. Four of the webs (Samples B, D, F and H) were produced with the use of the water spray, and the other four webs (Samples A, C, E and G) were produced under exactly the same conditions as the first four webs but without the water spray. In each case, the die orifices were 0.015 inch, and the web was collected on a wire covered roll located 8 inches from the die. When the water spray was used, it was introduced about 2 inches from the extrusion die. The operating conditions employed to produce each sample, and the results of tests conducted on each sample, are given in the Table on the following page. The tests identified in the Table were made substantially in accordance with the following procedures:

1. Grab Tensile Sum: The test is based on the *Federal Test Method No. 191*, method No. 5100 and normalized as follows: The sum of MD and CD grab tensile is divided by the basis weight. All units are converted to the metric system to have consistency and order. Therefore, the unit of grab tensile sum per basis weight is ($m^2$).

$$\frac{\text{Grab Tensile } (MD + CD)\ (gm)}{\text{Basis Weight } \frac{(gm)}{(m^2)}} = \text{Grab Tensile Sum } (gms/gm/m^2)$$

Both the MD and CD values are used in the normalization so as to eliminate any non-isotropic character. Five MD and CD tests are run for each experimental point reported.

TABLE

| Sample | A | B | C | D | E | F | G | H |
|---|---|---|---|---|---|---|---|---|
| | Operating Conditions | | | | | | | |
| Polymer rate (lb/hr/in) of die length** | 2.52 | 2.50 | 3.06 | 3.14 | 2.70 | 2.70 | 2.57 | 2.57 |
| Polymer melt temp (°F) | 600 | 600 | 600 | 600 | 595 | 595 | 600 | 600 |
| Air temp (°F) | 600 | 600 | 600 | 600 | 600 | 600 | 600 | 600 |
| Air pressure (PSIG) | 31 | 31 | 38 | 38 | 33 | 33 | 33 | 33 |
| Web forming speed (FPM) | 96 | 95 | 118 | 118 | 96 | 96 | 93 | 93 |
| Water spray rate (cc/min) | 0 | 250 | 0 | 250 | 0 | 250 | 0 | 250 |
| Polymer composition* | 100% PP | 100% PP | 100% PP | 100% PP | 100% PP | 100% PP | 75% PP 25% $N_6$ | 75% PP 25% $N_6$ |

*PP=polypropylene
$N_6$=Nylon 6
**20 inch Die

| Sample | A | B | C | D | E | F | G | H |
|---|---|---|---|---|---|---|---|---|
| | Test Results | | | | | | | |
| Basis wt. (g/m²) | 25.1 | 24.8 | 24.4 | 25.1 | 27.0 | 26.6 | 26.3 | 27.3 |
| Grab tensile sum [g/(g/m²)] | 161 | 184 | 193 | 205 | 186 | 187 | 117 | 131 |
| Trapezoidal tear [g/(g/m²)] | 12.7 | 25.1 | 12.0 | 22.2 | 12.1 | 26.1 | 5.4 | 10.9 |
| Stretch (%) MD | 21.9 | 43.4 | 24.9 | 42.2 | 24.7 | 42.8 | 16.9 | 21.5 |
| Stretch (%) CD | 29.3 | 48.1 | 34.3 | 47.8 | 33.7 | 49.2 | 18.1 | 26.8 |

2. Trapezoidal Tear Sum: The test is based on the *Federal Test Method No. 191*, method No. 5136 and normalized as follows: The sum of the MD and CD average trapezoidal tear values is divided by basis weight. All units are converted to the metric system for consistency and order.

$$\frac{\text{Trap Tear } (MD + CD)\ (gm)}{\text{Basis Weight } \frac{(gm)}{(m^2)}} = \text{Trap Tear Sum } (gms/gm/m^2)$$

Both the MD and CD values are used in the normalization so as to eliminate any non-isotropic character in the web. Five MD and CD tests are run for each experimental point reported. The average tear value for the web is interpreted as the mean value between the high and low tears.

3. Stretch is based on elongation to break as described in *Federal Test Method No. 191*, method No. 5136.

As can be seen from the data in the foregoing Table, the addition of the water spray (with all other operatng conditions held substantially constant) resulted in a significant improvement in the tear resistance and stretch characteristic of the final products. In certain cases there was also a slight improvement in tensile strength. Subjectively, these webs were also more textile-like with better drape and softness characteristics.

Even more significant than the improvement in product characteristics, however, is the fact that the addition of the liquid quench permitted the nonwoven webs to be produced at rates substantially in excess of 1.5 lbs./hr./inch of die width without excessive degradation of the product. Indeed, in the case of Sample D, the production rate was in excess of 3 lbs./hr./inch of die width. This is an extremely important advantage in commercial production because it means that any given production line can be operated at a substantially higher rate, without any sacrifices in product quality, by the inexpensive addition of a liquid spray between the extrusion die and the forming surface.

Figure 3:
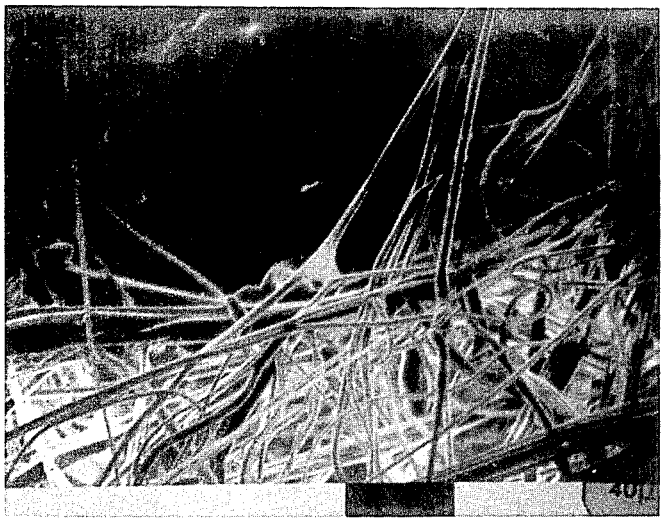
FIGS. 3 through 6 are scanning electron microscope photographs of exemplary nonwoven materials produced by the method and apparatus of FIG. 1.
Figure 4:
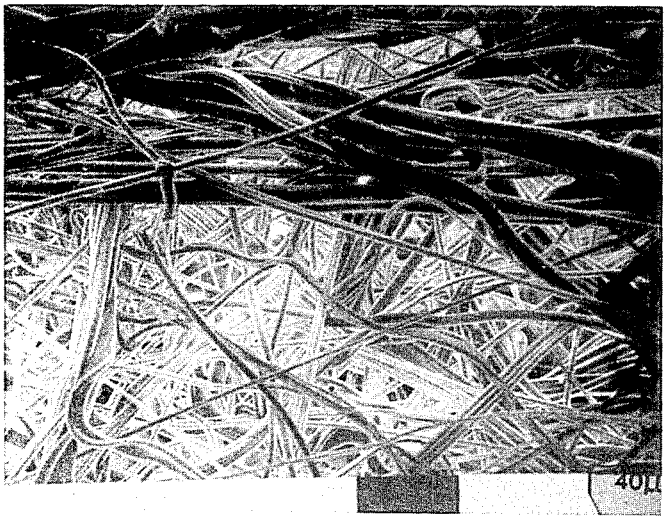
Figure 5:
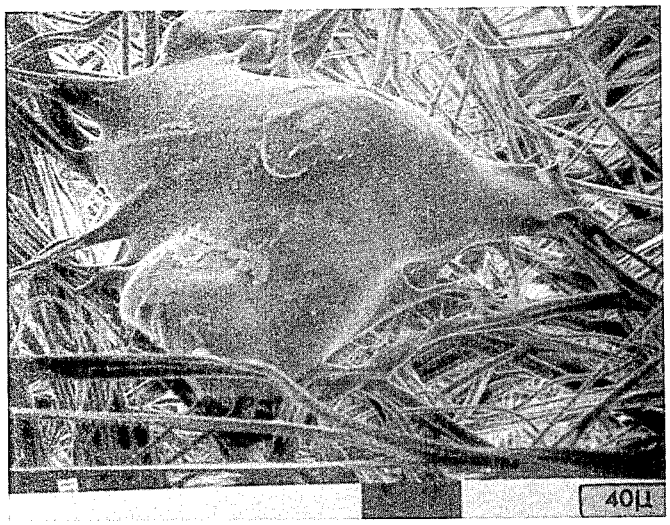
Figure 6:
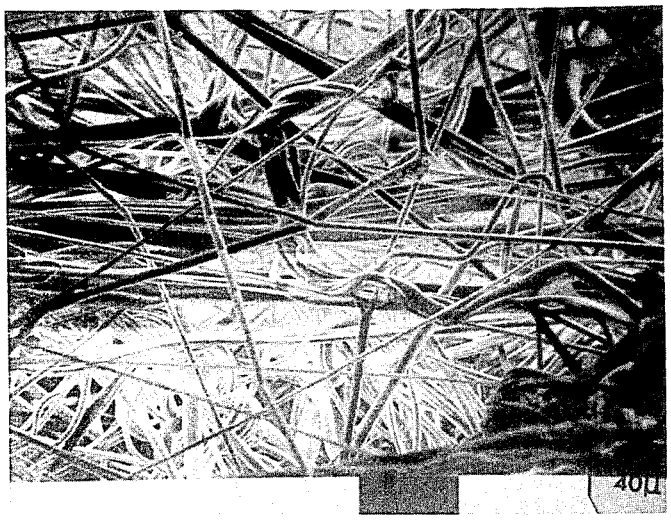

FIGS. 3–6 are scanning electron microscope photographs, at 500 x magnification, of Samples A, B, G and H, respectively, described above. FIG. 3 (Sample A, produced without the water spray) shows a large particle of shot, or agglomerated molten polymer, in the background, while FIG. 4 (Sample B, produced with the water spray) shows a web structure free of shot. FIG. 5 (Sample G, produced without the water spray) again shows a large particle of shot and molten fibers, while FIG. 6 (Sample H, produced with the water spray) shows a web structure free of shot.

We claim as our invention:

1. In a method of producing a nonwoven fabric-like material without excessive formation of shot and fiber bonding, said method comprising the steps of a. forming a gas stream containing melt blown microfibers in a molten condition, said microfibers comprising generally discontinuous synthetic, organic, thermoplastic polymeric microfibers having an average fiber diameter of up to about 10 microns, and b. directing said gas stream onto a forming surface to form a nonwoven fabric-like material in which said microfibers are held together by gross mechanical entanglement with each other, the improvement comprising the step of accelerating quenching of the melt blown microfibers before they reach the forming surface by spraying a liquid into said gas stream at a point where the melt blown microfibers are still at a temperature at which the microfibers would fuse together to form shot and fiber bonding and where the temperature of the gas stream is above the boiling point of said liquid so that said liquid is evaporated upon contact with the gas stream, said quenching by the liquid sparay avoiding the excessive formation of shot and fiber bonding.

2. A method as set forth in claim 1 wherein said liquid is sprayed into said gas stream from opposite sides thereof.

3. A method as set forth in claim 1 wherein said liquid is water which is sprayed into said gas stream at a point where the temperature of the gas stream is at least 250°F.

4. A method as set forth in claim 1 wherein said microfibers are formed by attenuating streams of polymeric material extruded from a die head to produce microfibers having an average diameter of less than about 10 microns, and the center of the liquid spray is located less than about 6 inches from said die head.

* * * * *